US010213824B2

(12) United States Patent
Mehalik

(10) Patent No.: US 10,213,824 B2
(45) Date of Patent: Feb. 26, 2019

(54) FASTENER REMOVAL TOOL AND METHOD OF USE

(71) Applicant: Donald E. Mehalik, North Braddock, PA (US)

(72) Inventor: Donald E. Mehalik, North Braddock, PA (US)

( * ) Notice: Subject to any disclaimer, the term of this patent is extended or adjusted under 35 U.S.C. 154(b) by 309 days.

(21) Appl. No.: 15/241,843

(22) Filed: Aug. 19, 2016

(65) Prior Publication Data

US 2017/0050235 A1 Feb. 23, 2017

Related U.S. Application Data

(60) Provisional application No. 62/208,260, filed on Aug. 21, 2015.

(51) Int. Cl.

| | |
|---|---|
| ***B25D 1/16*** | (2006.01) |
| ***B21J 15/50*** | (2006.01) |
| ***B25B 27/06*** | (2006.01) |

(52) U.S. Cl.

CPC ..... *B21J 15/50* (2013.01); *B25B 27/06* (2013.01); *B25D 1/16* (2013.01)

(58) Field of Classification Search

CPC ..... B21J 15/50; B25B 27/06; B25D 1/16
See application file for complete search history.

(56) References Cited

U.S. PATENT DOCUMENTS

| | | | | | |
|---|---|---|---|---|---|
| 2,297,885 | A * | 10/1942 | Graf | B21D 41/021 | 72/318 |
| 2,460,490 | A * | 2/1949 | Cook | B21D 41/04 | 184/6.14 |
| 3,103,068 | A * | 9/1963 | Hinz | B21D 39/046 | 285/382.5 |
| 3,143,189 | A * | 8/1964 | Ruple | B21J 13/08 | 185/37 |
| 3,422,518 | A * | 1/1969 | French | B21C 37/205 | 165/177 |
| 3,581,330 | A * | 6/1971 | Ortel | B21K 1/56 | 470/10 |
| 4,199,969 | A * | 4/1980 | Engel | B21D 41/04 | 72/76 |
| 4,995,252 | A * | 2/1991 | Robertson | B21B 17/08 | 72/194 |
| 5,016,460 | A * | 5/1991 | England | B21B 25/00 | 72/208 |

(Continued)

*Primary Examiner* — Ryan J. Walters
*Assistant Examiner* — Lawrence Averick
(74) *Attorney, Agent, or Firm* — Gary P. Topolosky

(57) ABSTRACT

A tool for removing a swaged fastener from a piece of equipment tubing includes, in combination with a slide hammer component, a multiple segment fastener that can be manually rotated between respective stations. The segments, around a central base, include: (a) a large hollow collar station for hammer-sliding back an innermost locking nut of the swaged fastener; (b) a large rounded-slit station for reverse-hammer sliding off an outermost ferrule of the swaged fastener; (c) an elongated tube station sized to fit over and abut a front end of the equipment tubing for hammer-sliding to push back its innermost ferrule; and (d) a small, rounded-slit station for positioning behind the pushed back innermost ferrule and reverse hammer-slide it off of the equipment tubing. A related method is also disclosed.

5 Claims, 5 Drawing Sheets

(56) References Cited

U.S. PATENT DOCUMENTS 5,090,102 A * 2/1992 Lovell ..... B25B 27/06 29/255
5,173,999 A * 12/1992 Welk ..... B25B 13/56 206/376
5,207,730 A * 5/1993 Ruggiero ..... B25D 1/16 29/255
5,564,304 A * 10/1996 Schlabach ..... B21D 1/06 173/90
6,062,060 A * 5/2000 Nguyen ..... B21D 17/02 72/317
6,125,719 A * 10/2000 Lowther ..... B25D 1/16 173/90
6,185,771 B1 * 2/2001 Trusty, Sr. ..... B25F 1/003 30/162
6,739,224 B1 * 5/2004 Wershe ..... B25G 1/085 7/138
6,892,559 B2 * 5/2005 Leiponen ..... B21B 19/06 72/38
6,920,773 B2 * 7/2005 Leiponen ..... B21B 19/06 72/38
7,036,211 B1 * 5/2006 Panks ..... B25B 27/02 173/29
7,861,572 B2 * 1/2011 Geser ..... B21J 5/12 72/125
7,984,538 B2 * 7/2011 McKay ..... B21D 39/046 29/237
8,713,735 B1 * 5/2014 Pelton ..... B26B 11/006 7/138
9,427,858 B2 * 8/2016 Duncan ..... B25F 1/04
9,533,407 B1 * 1/2017 Ragner ..... B25F 1/04
9,751,201 B2 * 9/2017 King, Jr. ..... H02G 1/1214
9,770,820 B1 * 9/2017 Ragner ..... B25F 1/003
9,925,654 B2 * 3/2018 Ragner ..... B25F 1/04
2006/0213014 A1 * 9/2006 Manske ..... B25B 15/00 7/165
2014/0059782 A1 * 3/2014 Duncan ..... B25F 1/00 7/138
2015/0052686 A1 * 2/2015 Davis ..... B25B 13/56 7/165
2015/0336257 A1 * 11/2015 Ragner ..... B25F 1/04 81/125.1
2016/0136800 A1 * 5/2016 King, Jr. ..... H02G 1/1214 7/108

* cited by examiner

FASTENER REMOVAL TOOL AND METHOD OF USE

CROSS-REFERENCE TO RELATED APPLICATION

This is a perfection of Provisional Application Ser. No. 62/208,260, filed on Aug. 21, 2015, the disclosure of which is fully incorporated by reference herein.

BACKGROUND OF THE INVENTION

1. Field of the Invention

The present invention relates to locking (or "lock in"), swage-type tube fasteners, sometimes called compression type fasteners. More particularly, this invention relates to a tool and method for removing such fasteners without damaging the underlying tube that was previously swaged.

2. Description of the Related Art

Swage fasteners and associated are known for use in numerous applications. An exemplary fastener of this type, like those sold by SwageLok®, Duolok® and/or SSP usually include a nut, with a front ferrule and back ferrule (or sometimes, a "collar") that swages onto metal tubing. Swageable fasteners have been widely employed in a variety of applications for which related components/surrounding equipment may be quite expensive. These locking (or lock-in) fasteners are often installed in cramped confines. A swaged fastener must be removed from the structure to which it is mounted if the fastener has been swaged improperly or if the apparatus otherwise must be disassembled. Some previously known methodologies for removing swaged fasteners have employed chisel-type devices and hammers, or alternatively employed cut-off wheels. But such methodologies often resulted in breaking the components rendering them useless for reuse and/or damaging the section(s) of equipment (i.e. tubing) to which the fastener is mounted. These prior removal practices raised safety concerns and were relatively slow and inefficient. Once an "old" fastener is completely removed, a new system/fastener may be substituted therefor. For certain tubing operations, in close confines, it has been difficult to safely and/or rapidly remove the former fastener before one can install the next replacement/equivalent.

Some repair operations resort to cutting off the old part(s) before replacing with a new swage fastener. When making such cuts, damaging cuts to the underlying tubing occurs too frequently. The present invention makes old swage fastener (both nut and ferrules) quick, easy and "safe to the underlying tubing").

As is understood in the relevant art, there are numerous methods and devices for fastener removal starting with tools of Brazil et al U.S. Pat. No. 2,688,185, method of Scudieri et al U.S. Pat. No. 3,130,493 and/or the apparatus & method of Haines Jr. U.S. Pat. No. 7,308,746.

This invention provides an uncomplicated, inexpensive, easily transportable alternative for use with most any swage fastener arrangement.

It is desired to provide an improved tool for removing (without cutting) the nut, ferrule and/or collar of a swaged fastener from the underlying componentry (i.e. equipment tubing) to which it is mounted. Such a tool (and its method of use) would not raise safety concerns of the type raised in conjunction with using cut-off wheels. Instead, it will operate easily (manually) and relatively quickly. Old fastener removal can occur in less than one minute PER fastener even after rotating through the various (four) stations of this nut/ferrule removal tool.

Such a tool would be relatively to manufacture and store and also have a long useful lifespan.

SUMMARY OF THE INVENTION

An improved fastener removal tool in accordance with the present invention meets these and other needs. It is configured to remove from tubing clamped down (or secured in a vice) a swaged fastener having a threaded nut end and at least one, possibly two ferrules for swaging to the tube or tubing. It does not remove nuts and ferrules from tubing still connected to the rolls or other machinery as: (i) such tubing will still have grease inside or thereabout; and (ii) removal requires holding the tubing firmly as in a vice. If still connected, there are constraints on spacing about the tubing against which to hammer off the various components AND without properly securing the tubing, it will move about too much (or be too "flexible") so that effective hammering cannot be accomplished.

The fastener removal tool itself can be integrally formed as part of a slide hammer, or alternately configured for affixing as an adapter end to one's own existing slide hammer arrangement.

An aspect of the present invention is to provide an improved fastener removal apparatus that can remove a swaged fastener from a component without damaging the component (or underlying tube/tubing).

Another aspect of the present invention is to provide an improved fastener removal apparatus that does not raise safety concerns of the type raised in conjunction with the use of cut-off wheels.

Another aspect of the present invention is to provide an improved fastener removal tool that can be used to remove conventional threaded fasteners, such as conventional nuts and ferrules.

Another aspect of the present invention is to provide an improved fastener removal tool that is relatively inexpensive to manufacture and operate.

Another aspect of the present invention is to provide an improved fastener removal tool having a relatively long life span.

Another aspect of the present invention is to provide an improved fastener removal tool that operates relatively quickly.

BRIEF DESCRIPTION OF PHOTOGRAPHS

A further understanding of this invention can be gained from the following Description of the Preferred Embodiments made with reference to the accompanying photographs in which.

Figure 6:
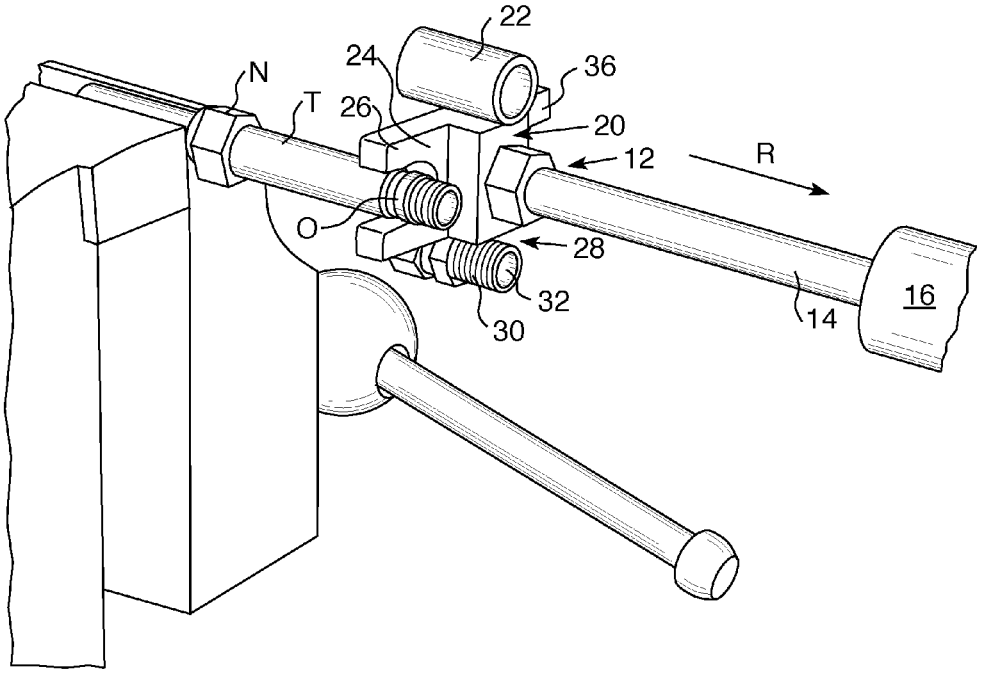
FIG. 6 is a perspective view showing the tool rotated 90 degrees clockwise, to the second of its four work stations, the rounded fork tip to this second segment being positioned behind the tubing's outermost ferrule for slide hammering, in an opposite direction from that shown in FIGS. 4, 5 and 7, to remove the ferrule off the forward-most end of the tubing.
Figure 7:
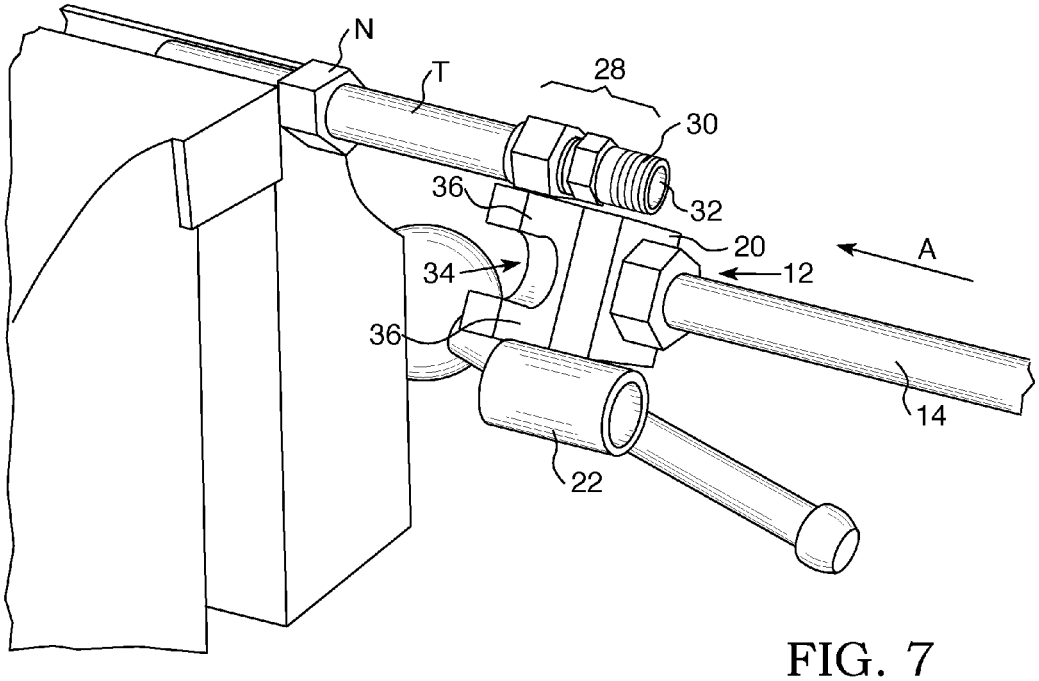
FIG. 7 is a perspective view showing the tool rotated another 90 degrees to its third of four work stations, this segment designed for fitting adjacent the inner (or second) ferrule and then slide hammering that inner/second ferrule inwardly (in the same direction as FIGS. 4 and 5) and initially away from the forward-most tubing end.
Figure 8:
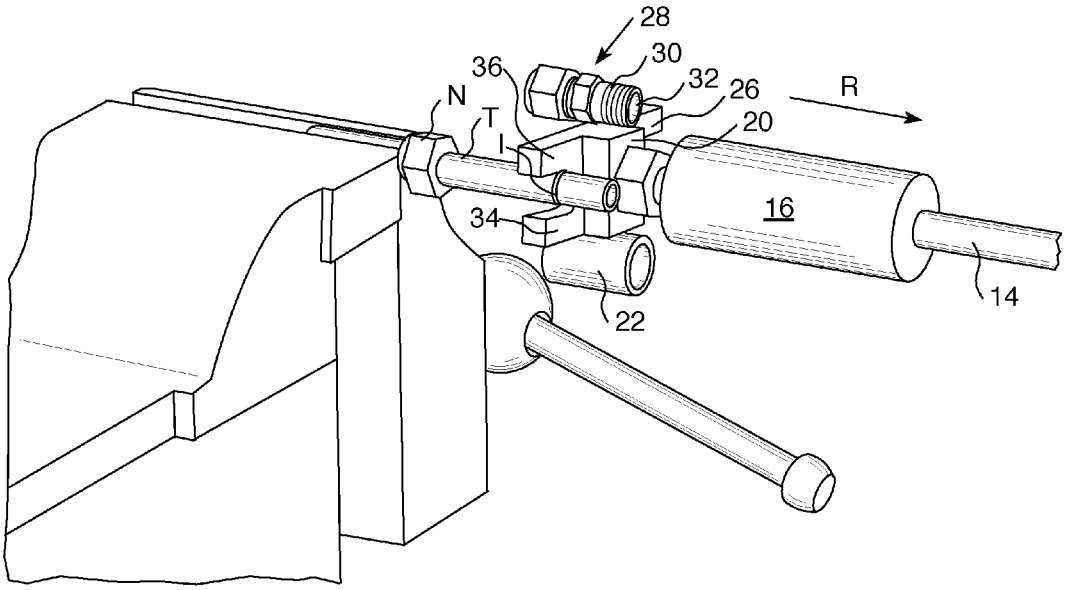
Figure 9:
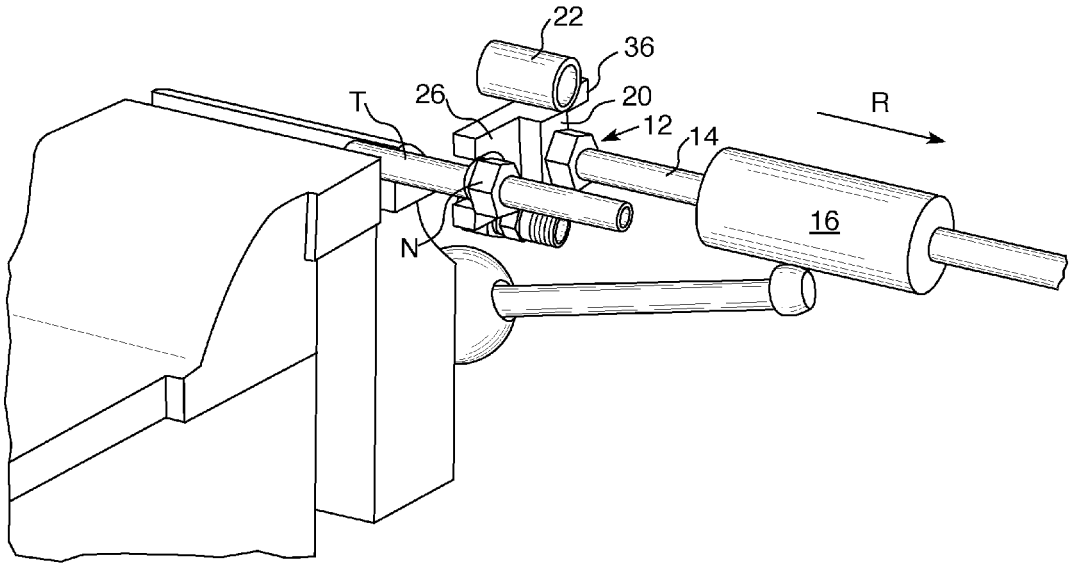

FIG. 8 is a perspective view showing the tool rotated one last direction, the last 90 degrees (clockwise) for locating the larger rounded fork end in the last stages of swaged tip removal; in this first sub-step, the last tool segment is positioned behind the loosened, second ferrule and then slide hammered in the same direction as per FIG. 6 (away from the forward-most tubing end) for fully removing this second ferrule off the tubing end proper; and FIG. 9 is a perspective view showing the next sequential phase from FIG. 8, which, in this case uses the second station of tool end, now positioned BEHIND the innermost fastener nut before being slide hammered (in the same direction as FIGS. 6 and 8) away from the forward-most tubing end to completely remove this fastener nut from the tubing end (for possible reuse, if so desired).

DESCRIPTION OF PREFERRED EMBODIMENTS

Figure 1:
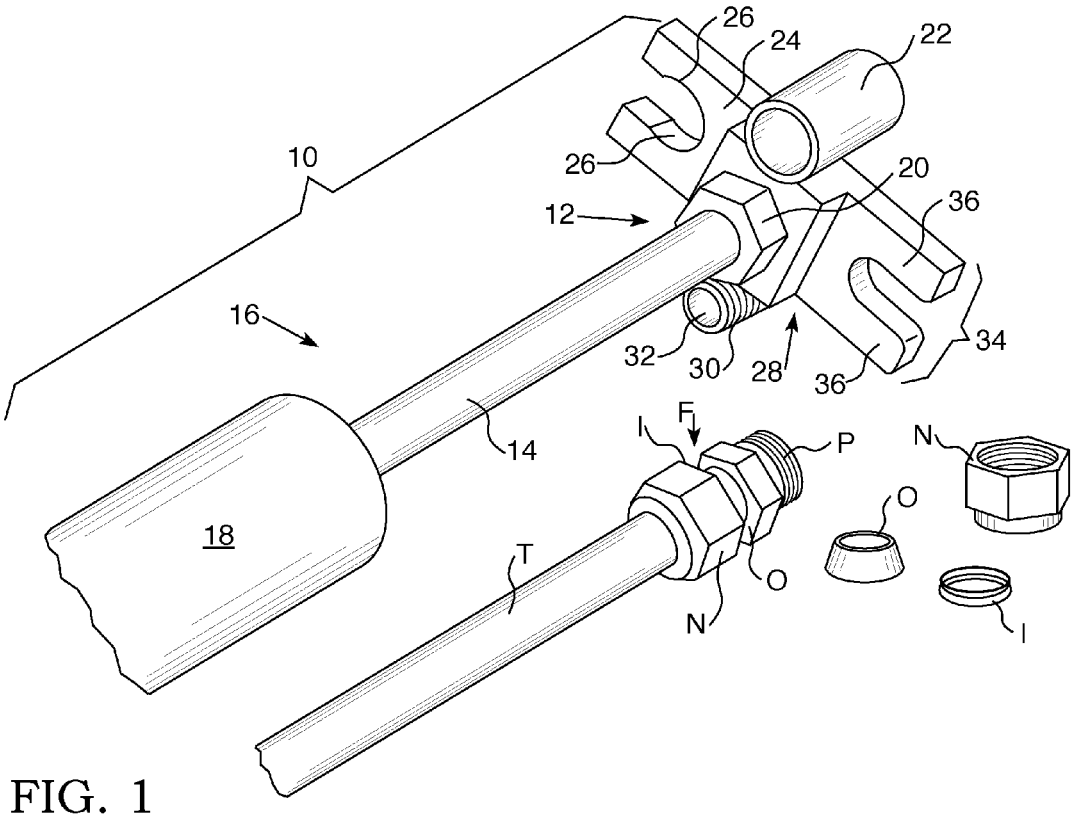
FIG. 1 is a top perspective view of a section of tubing to which has been previously swaged a connector/fastener for removal using the tool apparatus of this invention shown to the left of the tubing. The two ferrules (inner and outer) and innermost nut are shown to the right of this same tubing.
Figure 2:
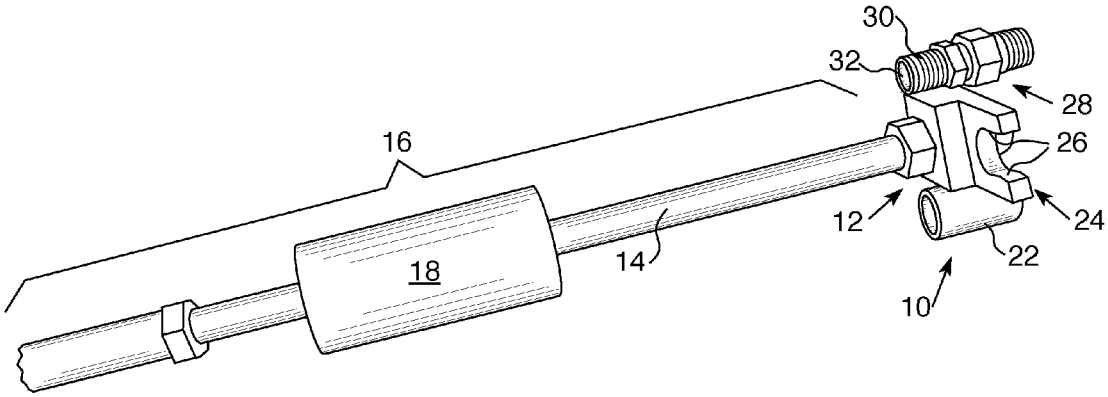
FIG. 2 is a top perspective view of the apparatus of this invention showing its attachment to to the top right of a typical slide hammer arrangement.
Figure 3:
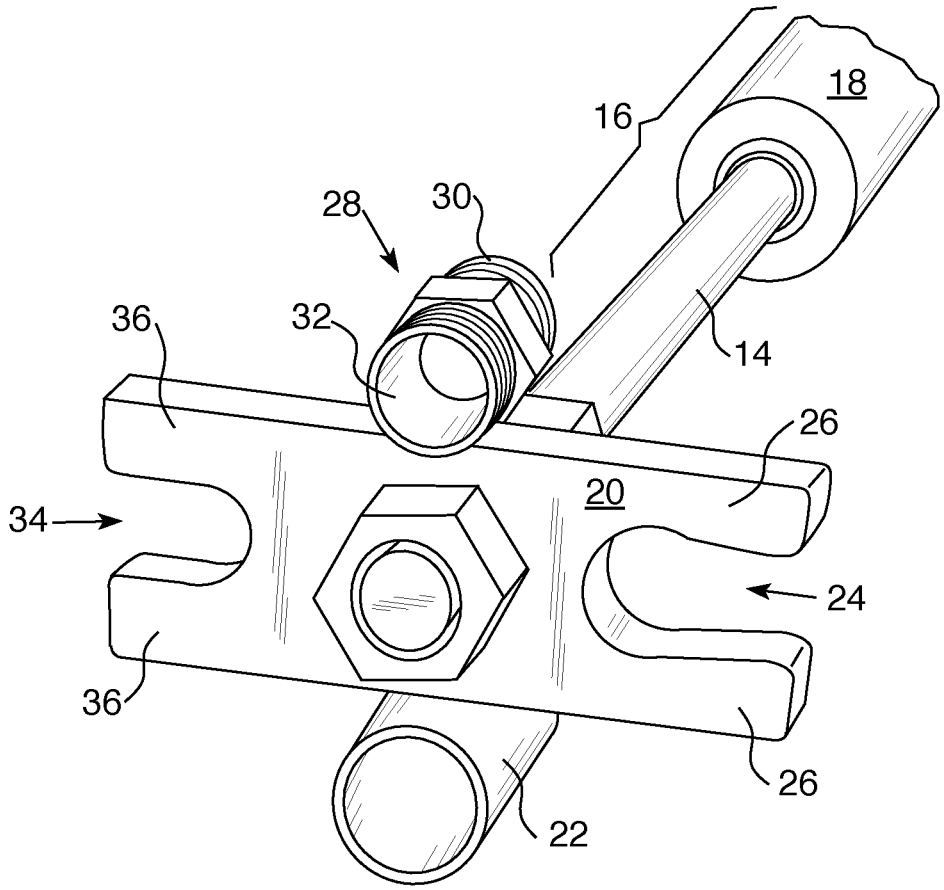
FIG. 3 is a front axial view of the apparatus from FIG. 2.
Figure 4:
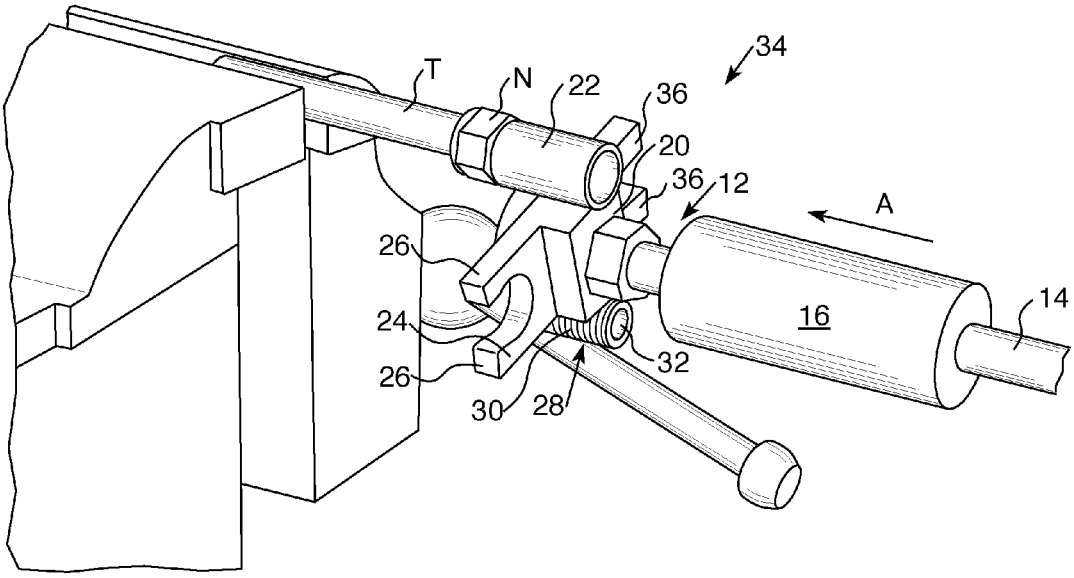
FIG. 4 is a perspective view of a section of tubing, held in a vice, to which the first segment of the tool is being used to first hammer back the nut and ferrules.
Figure 5:
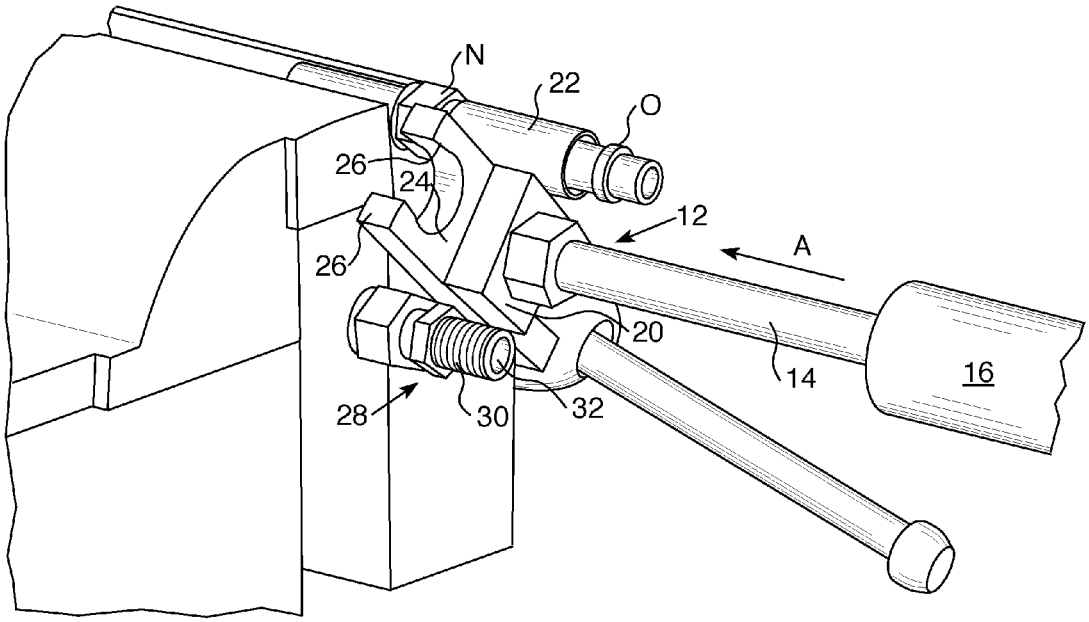
FIG. 5 is a perspective view further in sequence to FIG. 4 showing the ferrule pushed a sufficient distance back of the forward-most tubing end.

Referring now to the accompanying drawings, the tool (generally 10) is adapted for including onto a front end 12 of the shaft 14 of a typical hammer slide 16 with its own hammer handle 18. The tool 10 preferably has four "stations" that easily rotate about a central axis or base 20. The first such station is an elongated collar tube 22 that is sized to fit over a swaged tube and abut the old fastener to be removed. FIG. 1 shows a representative piece of tubing T having at one end a threaded tip P, an inner ferrule I and an outer ferrule O (neither of which are clearly visible in this view, but in the general area of tubing ferrules F), and an innermost locking nut N that, when tightened, secured the swage to the tubing end.

Through a series of hammer slides TOWARD the fastener (direction arrow A) with tool 10 properly positioned in place, the innermost locking nut N of this fastener will get pushed back (or inwardly) a sufficient distance along the tubing T as it is held in a vice grip. In an alternative embodiment (not shown), this tubular first station could be replaced with a different sized, rounded slit or possibly even a forked end component.

The next (or second) station 24 of this tool (with its larger of two rounded slits 26) gets positioned ON THE TUBING, behind its larger outermost ferrule O, for hammer sliding in an opposite or reverse direction (arrow R) AWAY from tubing T to easily remove that outer ferrule O with a simple, hammering motion rather than by any ferrule-cutting means.

Next, tool 10 is rotated another 90 degrees to its third station 28 with its large externally threaded collar 30 (with a smooth hollow interior 32). This third station collar is sized within (or, at least, abut against) the fitting remainder of the previously swage-locked tubing. In some instances, it may be sized to fit at least partially into a remaining outermost component of the swage lock on tubing T.

This externally threaded third station component 28 has been welded to the central base 20 opposite the elongated first station collar tube 22. Alternatively, it may be attached to the body proper of the removal tool using a set screw (not shown). In any event, this main station is preferentially sized to match the locking component that it is helping to remove. In the event excessive use of this tool renders this sub-component "worn out", it may be removed and replaced as needed. In yet another alternative, component 28 may consist of a fitting (not shown) that has been drilled and tapped to a preferred diameter.

The third station gets positioned on the tubing (after outer ferrule O has been completely removed from tubing T) and then with hammer sliding, once more in the direction of arrow A (or inwardly toward) the tubing proper, it will loosen and then sufficiently push back the innermost ferrule I from along tubing T . . . away from where it was originally swaged down and onto tubing T for initial fastening purposes.

Lastly, for the fourth station 34, there is the smaller of two circularly shaped "fork ends" 36 that sit roughly 180 degrees apart—or across—from the larger fork ends of second station 24. A preferred use of this fourth rotation station is for situating tool 10 axially inwardly (i.e. along the tubing T behind the loosened inner ferrule I) for then hammering away from (reverse arrow R) the tubing proper to thus pull that inner ferrule I (intact) and off the open end of tubing T. If not scarred, this removed inner ferrule could possibly be cleaned up and re-greased for reuse.

Once inner ferrule I is hammered off the tubing, larger station two, item 24, can be relocated behind the fastener's main innermost locking nut N. Then, with a series of slide hammerings AWAY from the tubing, the second station 24 of tool 10 can be used to pull this fastener nut completely off of the remainder of tubing T (possibly for reuse as well).

In any event, the method of using this four-staged tool to remove a swaged fastener from over the tubing that it was once installed will NOT damage the tubing body. Nothing comes close to crimping the tubing or cutting it in any manner as to possibly damaging the tubing body. No nuts or ferrules (inner OR outer) need be cut from that tubing before the replacement fastener is readied for installation, or technically re-installing thereover.

Rotating through the four stations and manipulation of the slide hammer in alternating opposite directions takes less than one minute TOTAL and achieves a cleaned off (fastener-free section of tubing proper that can be quickly and cleanly re-fitted with its new, next fastener substitution for the earlier/older version that was just so easily removed by the present invention.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents.

What is claimed is:

1. A tool for removing swaged fasteners from a piece of equipment equipment tubing, said swaged fastener removal tool comprising: (a) a slide hammer component; and (b) a central base extending from one end of the slide hammer component, said central base including a multiple segment fastener that can be manually rotated between respective stations, said multiple segment fastener including:

(i) a large hollow collar station for hammer-sliding back an innermost locking nut of the swaged fastener on the piece of equipment tubing;

(ii) a large rounded-slit station for reverse-hammer sliding off an outermost ferrule of the swaged fastener on the piece of equipment tubing;

(iii) an elongated tube station sized to fit over a front end of the piece of equipment tubing and abut a fastener for hammer-sliding to push back an innermost ferrule on the piece of equipment tubing; and (iv) a small, rounded-slit station for positioning behind the pushed back innermost ferrule and reverse hammer-sliding the innermost ferrule forward and off the front end of the piece of equipment tubing.

2. The swaged fastener removal tool of claim 1 wherein, after removal of the innermost ferrule, the large rounded-slit station is used for reverse-hammer sliding off the innermost locking nut of the swaged fastener on the piece of equipment tubing.

3. The swaged fastener removal tool of claim 1 wherein the elongated tube station includes a threaded nut component that can be replaced when worn out.

4. The swaged fastener removal tool of claim 1 wherein the elongated tube station includes a fitting welded to the central base on one side.

5. The swaged fastener removal tool of claim 1 wherein the elongated tube station includes a fitting that has been drilled and tapped to a preferred diameter.

* * * * *